US005585820A

United States Patent [19]

Nishigaki et al.

[11] Patent Number: 5,585,820

[45] Date of Patent: Dec. 17, 1996

[54] APPARATUS FOR AND METHOD OF GENERATING CHARACTERS

[75] Inventors: Tetsuo Nishigaki, Kanagawa; Takamichi Mitsuhashi, Saitama, both of Japan

[73] Assignee: Sony Corporation, Tokyo, Japan

[21] Appl. No.: 228,216

[22] Filed: Apr. 15, 1994

[30] Foreign Application Priority Data

Apr. 16, 1993 [JP] Japan ..... 5-090252

[51] Int. Cl.[6] ..... G09G 5/22

[52] U.S. Cl. ..... 345/144; 345/133; 345/141; 345/147

[58] Field of Search ..... 345/141, 142, 345/143, 144, 147, 189, 192, 194, 149, 115, 113, 114, 136, 138, 133; 395/144, 145, 150

[56] References Cited

U.S. PATENT DOCUMENTS

| | | | |
|---|---|---|---|
| 4,945,351 | 7/1990 | Naiman | 345/147 |
| 4,992,781 | 2/1991 | Iwasaki et al. | 345/138 |
| 5,365,251 | 11/1994 | Denber | 345/136 |
| 5,404,432 | 4/1995 | Koopman et al. | 345/144 |

FOREIGN PATENT DOCUMENTS

| | | | |
|---|---|---|---|
| 0393756 | 10/1990 | European Pat. Off. | 345/144 |

*Primary Examiner*—Richard Hjerpe
*Assistant Examiner*—Kent Chang
*Attorney, Agent, or Firm*—William S. Frommer; Alvin Sinderbrand

[57] ABSTRACT

A shade pattern can be added characters or character strings by a simple arrangement. Count values of a vertical direction counter (2) and a horizontal direction counter (3) are supplied to an address signal generator (4), and an address signal from the address signal generator (4) is supplied to a memory, i.e. RAM (5), in which character codes to be displayed, etc., are stored. A character code from the memory (5) is supplied to a memory, i.e. ROM (6) in which character patterns and so on are stored. Count values of a character vertical counter (7) and a character horizontal counter (8) are supplied to the memory (6) which derives a signal representing a character pattern to be displayed. The signal representing the character code or the like from the memory (5), the signal representing character codes to be displayed on peripheral portions and the count values of the counters (7), (8) are supplied to a pattern generator (9) which generates a shade pattern signal. The shade pattern signal and the character pattern signal are supplied to a pattern synthesizer (10) which generates a displaying synthesized pattern signal.

12 Claims, 10 Drawing Sheets

| | | | | | | |
|---|---|---|---|---|---|---|
| N | N | N | N | N | N | N |
| U | U | U | U | U | U | N |
| U | U | U | U | N | U | U |
| U | U | U | U | U | U | U |
| D | D | D | U | D | N | N |
| D | D | U | D | D | D | N |
| N | D | D | D | D | N | N |

APPARATUS FOR AND METHOD OF GENERATING CHARACTERS

BACKGROUND OF THE INVENTION

FIELD OF THE INVENTION

The present invention relates to apparatus for and method of generating characters for use in displaying data representing operation menu obtained when the user operates some suitable audio-video equipments, such as a television receiver, a video tape recorder or the like.

Heretofore, a television receiver or video tape recorder (VTR) has a menu panel to display data representing operation menu obtained when the user operates the television receiver or video tape recorder so that the television receiver or video tape recorder can become easier to handle. When data representing operation menu is displayed on the menu panel of the monitor, it is customary that a displaying portion is made conspicuous by adding a shade to characters, character strings to be displayed or the like in such a manner as to make the displaying portion conspicuous in a so-called pop-up mode as shown in FIG. 1A or to make the displaying portion conspicuous in a so-called pull-down mode as shown in FIG. 1B.

As a method of adding a shade to character or character strings, it is customary that character patterns having shade pattern added thereto are formed beforehand and stored in a memory, i.e., ROM (read-only memory) in which there are stored data, such as character patterns or the like. Then, these character patterns are selected and displayed on the menu panel of the monitor of audio-video equipments, such as the television receiver or the like when necessary. However, according to the above-mentioned conventional method, the ROM needs a memory capacity more than twice as large as the original one to memorize therein data, such as character pattern, etc., which imposes a serious problem when there are many kinds of characters to be displayed on the monitor.

Another method is proposed to add a shade to characters or character strings by designating a shade pattern as a character displaying attribute code after the shade pattern was defined in such usual fashion as to underline the characters, for example. When however the shade pattern is displayed according to this conventional method, it becomes necessary to prepare 16 shade patterns in total of 1 shade pattern used when the shade pattern is not displayed at all, 4 shade patterns used when the shade pattern is displayed only on one of four peripheral sides of a displaying portion, 6 shade patterns used when the shade pattern is displayed on two displaying portions, 4 shade patterns used when the shade pattern is displayed on three displaying portions and 1 shade pattern used when the shade pattern is displayed on the whole displaying portion.

Therefore, a 4-bit display attribute code is required in order to designate the shade pattern. Since the 4 bit display attribute code is stored in a memory together with a character specifying code for every character, it is unavoidable that a memory, i.e., RAM (random access memory) needs a memory capacity large enough to memorize therein the displaying attribute code and the character specifying code. Further, it is not so easy to set the displaying attribute codes of the shade patterns to every characters.

Furthermore, when a displaying portion is made conspicuous by adding the shade pattern to character patterns or the like, according to the conventional methods, it is unavoidable that the ROM needs a storage capacity large enough to store therein data, such as character patterns, etc., or that the RAM also needs a storage capacity large enough to store therein character codes or the like.

OBJECTS AND SUMMARY OF THE INVENTION

It is therefore an object of the present invention to provide apparatus for and method of generating characters in which the aforesaid shortcomings and disadvantages encountered with the prior art can be eliminated.

It is another object of the present invention to provide a method of and apparatus for generating characters in which shade patterns can be added to characters without special character patterns and display attribute codes formed of many bits by a simple arrangement.

According to a first aspect of the present invention, there is provided an apparatus for generating characters which are displayed in a character displaying area on a monitor, the character displaying area being divided into a center area and a peripheral area and the characters being displayed in the center area of the character displaying area. This apparatus is comprised of means for memorizing display data to be displayed in the character displaying area, comparing means for comparing the display data of the character displaying area with the display data to be displayed in an adjacent character displaying area, and means for controlling a shade of the peripheral area of the character displaying area in response to an output of the comparing means.

According to a second aspect of the present invention, there is provided a method for generating characters which are displayed on a monitor. This method is comprised of the steps of generating display data to be displayed in a character displaying area on the monitor, the character displaying area being divided into a center area and a peripheral area, comparing the display data which are displayed in adjacent character displaying areas, and controlling a shade of the peripheral area of the character displaying area in response to a compared output.

The above and other objects, features, and advantages of the present invention will become apparent from the following detailed description of illustrative embodiments thereof to be read in conjunction with the accompanying drawings, in which like reference numerals are used to identify the same or similar objects.

DETAILED DESCRIPTION OF THE PREFERRED EMBODIMENTS

The present invention will now be described with reference to the drawings.

Figure 1A:
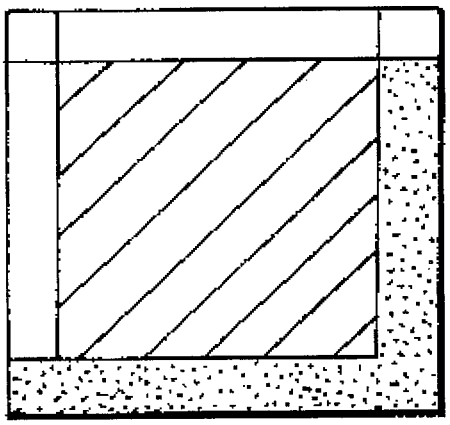
FIG. 1A (PRIOR ART)
FIGS. 1A and 1B are schematic diagrams used to explain how to make a displaying portion conspicuous in a pop-up mode and in a pull-down mode according to the prior art.
Figure 1B:
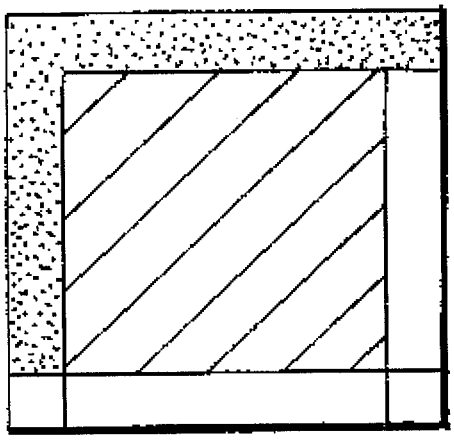
FIG. 1B (PRIOR ART)
Figure 2:
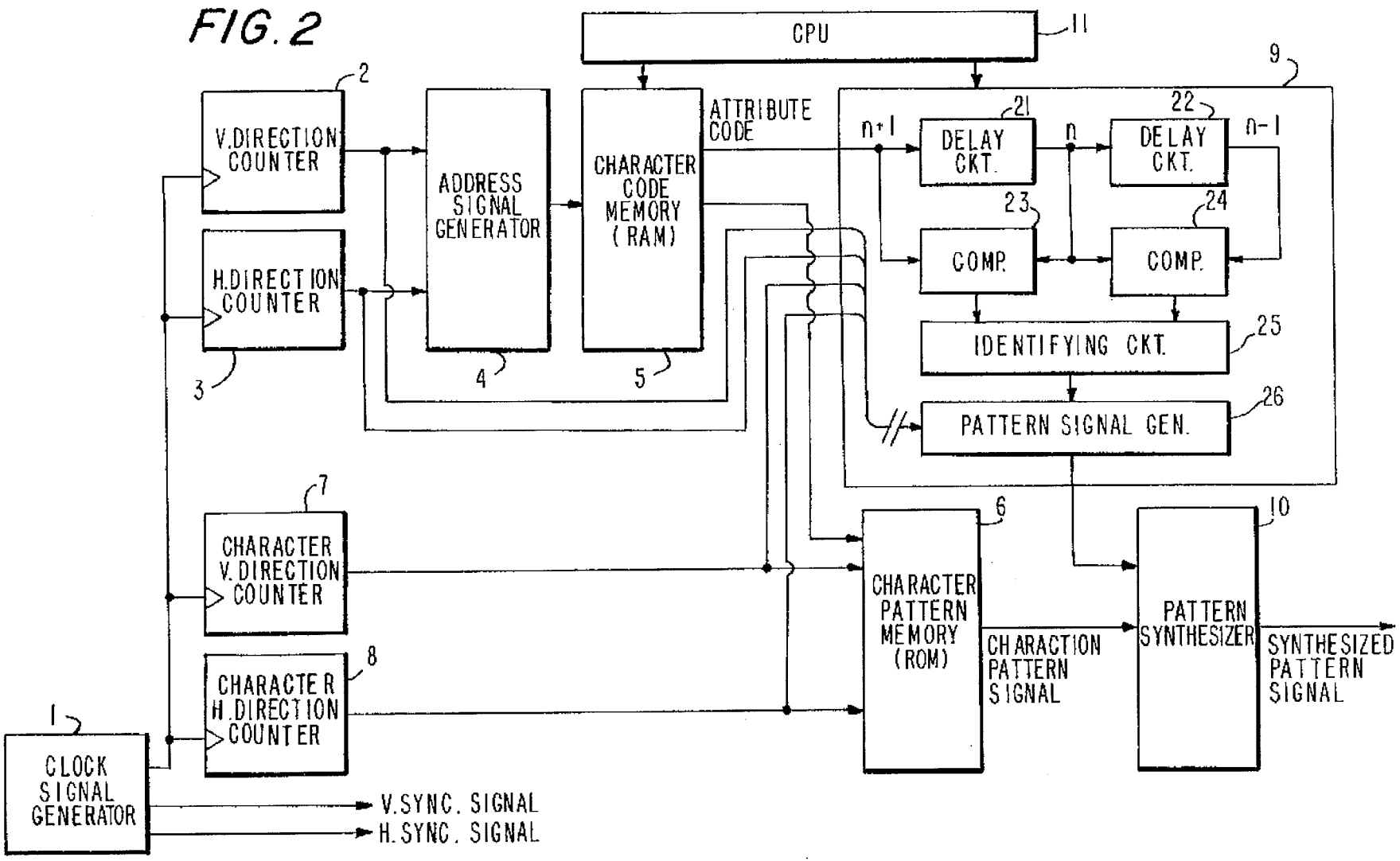
FIG. 2 is a block diagram showing a circuit arrangement of an apparatus which can realize a method of generating characters according to the present invention.

FIG. 2 of the accompanying drawings shows in block form an example of an apparatus for realizing a method of generating characters according to the present invention. As shown in FIG. 2, there is provided a clock signal generator 1 which generates a clock signal of each pixel for forming a pattern signal, such as a character or the like, and vertical and horizontal synchronizing signals.

The clock signal from the clock signal generator 1 is supplied to a vertical direction counter 2 and a horizontal direction counter 3. Count values of the vertical direction counter 2 and the horizontal direction counter 3 are supplied to an address signal generator 4 which generates an address signal. The address signal from the address signal generator 4 is supplied to a character code memory 5 (formed of a RAM) which derives a character code corresponding to the address signal supplied thereto and an attribute code of the character code. The attribute code is used to determine whether a character code displaying area is displayed in the pop-up or pull-down mode. The attribute code can be designated by an external CPU (central processing unit) 11. The character code outputted from the character code memory 5 is supplied to a character pattern memory 6 formed of a ROM. The clock signal from the clock generator 1 is supplied to the character vertical direction counter 7 and a character horizontal direction counter 8. Count values of the character vertical direction counter 7 and the character horizontal direction counter 8 are supplied to the character pattern memory 6, whereby the character pattern memory 6 outputs a character pattern signal corresponding to the character code to a predetermined position on a picture screen.

Figure 3A:
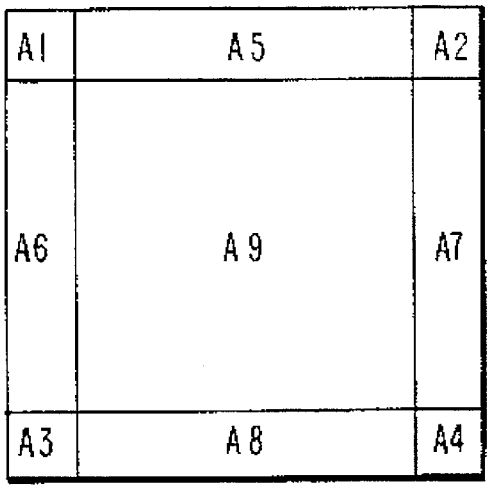
FIG. 3A and 3B are schematic diagrams used to explain a center area and peripheral areas of a character displaying area and displaying portions, respectively.

The attribute code read out from the character code memory 5 is supplied to a pattern generator 9 to which there are supplied outputs from the vertical direction counter 2, the horizontal direction counter 3, the character vertical direction counter 7 and the character horizontal direction counter 8. The pattern generator 9 has two functions. That is, one function of the pattern generator 9 is to generate a pattern signal representing a character displaying area shown in FIG. 3A. The pattern signal generated from the pattern generator 9 is comprised of a center area A9 in which characters are displayed and peripheral areas A1 through A8 as shown in FIG. 3A. The other function of the pattern generator 9 is to compare attribute codes of contiguous areas and determine brightness and shade of peripheral areas in response to a compared output.

A circuit arrangement of the pattern generator 9 will be described below. This circuit arrangement of the pattern generator 9 generates the pattern signal for displaying a character string of one row in the pop-up mode. The character string of one row is uniquely determined by the attribute code such that a peripheral upper portion of the area pattern signal is displayed bright and a peripheral lower portion of the area pattern signal is displayed dark. Lightness of the peripheral right and left portions is determined by comparing the attribute codes of adjacent areas. The attribute code is supplied to delay circuits 21, 22 connected in series which derive attribute codes of consecutive three areas simultaneously. Then comparators 23, 24 compare the attribute codes of adjacent areas with each other. When the attribute codes are coincident with each other, an identifying circuit 25 supplies a control signal to a pattern signal generator (or area forming circuit) 26 so that the peripheral right and left portions are displayed in gray. When the compared output from the comparator 24 represents that the attribute codes are not coincident with each other, the identifying circuit 25 supplies a control signal to the pattern signal generator 26 so that the peripheral left portion is displayed bright. When the compared output from the comparator 24 represents that the attribute codes of the adjacent areas are not coincident with each other, the identifying circuit 25 supplies a control signal to the pattern signal generator 26 so that the peripheral right portion is displayed dark. The character pattern signal from the character pattern memory 6 and the pattern signal generated from the pattern signal generator 26 are supplied to a pattern synthesizer 10, in which they are synthesized and then outputted as a synthesized pattern signal. According to the aforesaid control, the shadow that can display the character displaying area in the pop-up or pull-down mode with ease can be casted upon the character pattern.

While the pattern generator 9 shown in FIG. 2 shows an example of the simplest circuit which generates the area pattern signal representing the character string of one row, it is possible to realize a circuit which generates an area pattern signal representing character strings of a plurality of rows by combining a plurality of the circuit examples of the pattern generator 9 fundamentally.

A method of casting a shadow upon character patterns so that displaying areas of a predetermined character string are displayed in the pop-up mode will be described below.

As earlier noted, in response to the area signal from the pattern signal generator 26, a displaying portion of one character is divided to provide at least four corner areas A1, A2, A3, A4, upper, lower, left and right peripheral areas A5, A8, A6, A7 sandwiched by the four corner areas A1, A2, A3, A4, and a center area A9 as shown in FIG. 3A.

Figure 3B:
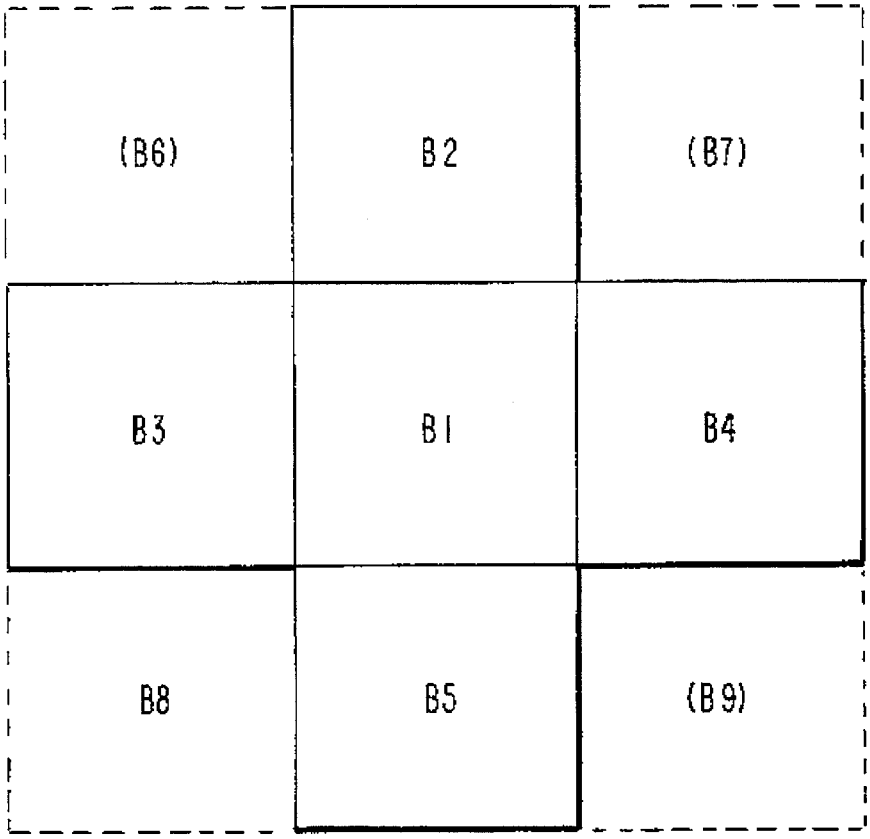

The character code memory 5 supplies an attribute signal of a displaying portion B1 for displaying one character and attribute signals of peripheral displaying portions B2, B3, B4, B5 to the pattern generator 9 as shown in FIG. 3B. More specifically, when the address signal generated from the address signal generator 4 corresponds to the displaying portion B1, the attribute signal corresponding to the displaying portion B1 and the attribute signals corresponding to the peripheral display portions B2 through B5 are supplied to the pattern generator 9.

Initially, the attribute code corresponding to the displaying portion B1 is detected. If the detected attribute code represents that a displaying portion is not the character displaying area, or the attribute code represents a special value, then the whole displaying area is displayed in gray. If the attribute code corresponding to the displaying portion B1 represents that the displaying portion is the character displaying area, then the areas A1 through A9 are displayed as follows.

In the area A1, the attribute codes corresponding to the displaying portions B2, B3 are detected. If any one of the attribute codes corresponding to the displaying portions B2, B3 represents the special value, then the area A1 is displayed in white. If the attribute codes corresponding to the displaying portions B2, B3 are both the normal attribute codes then the area A1 is displayed in gray.

In the area A2, attribute codes corresponding to the displaying portions B2, B4 are identified. If the attribute code corresponding to the displaying portion B2 is the attribute code of the special value, then the area A2 is displayed in white. If the attribute code corresponding to the displaying portion B2 is the normal attributes code and the attribute code corresponding to the displaying portion B4 is the attribute code of the special value, then the area A2 is displayed in black. Further, if the attribute codes corresponding to the displaying portions B2, B4 are both the normal attribute codes, then the area A2 is displayed in gray.

In the area A3, the attribute codes corresponding to the displaying portions B3, B5 are identified. If the attribute code of the displaying portion B5 is the attribute code of the special value, then the area A3 is displayed in black. If the attribute code corresponding to the displaying portion B5 is the normal attribute code and the attribute code corresponding to the displaying portion B3 is the attribute code of the special value, then the area A3 is displayed in white. Further, if the attribute codes corresponding to the displaying portions B3, B5 are both the normal attribute codes, then the area A3 is displayed in gray.

In the area A4, the attribute codes corresponding to the displaying portions B4, B5 are identified. If any one of the attribute codes corresponding to the displaying portions B4, B5 is the attribute code of the special value, then the area A4 is displayed in black. If the attribute codes corresponding to the displaying portions B4, B5 are both the normal attribute codes, then the area A4 is displayed in gray.

In the area A5, the attribute code of the displaying portion B2 is identified. If the attribute code corresponding to the displaying portion B2 is the attribute code of the special value, then the area A5 is displayed in white. If on the other hand the attribute code corresponding to the displaying portion B2 is the normal attribute code, then the area A5 is displayed in gray.

In the area A6, the attribute code of the displaying portion B3 is identified. If the attribute code corresponding to the displaying portion B3 is the attribute code of the special value, then the area A6 is displayed in white. If on the other hand the attribute code of the displaying portion B3 is the normal attribute code, then the area A6 is displayed in gray.

In the area A7, the attribute code of the displaying portion B4 is identified. If the attribute code corresponding to the displaying portion B4 is the attribute code of the special value, then the area A7 is displayed in black. If on the other hand the attribute code corresponding to the displaying portion B4 is the normal attribute code, then the area A7 is displayed in gray.

Similarly, in the area A8, the attribute code of the displaying portion B5 is identified. If the attribute code corresponding to the displaying portion B5 is the attribute code of the special value, then the area A8 is displayed in black. If on the other hand the attribute code corresponding to the displaying portion B5 is the normal attribute code, then the area A8 is displayed in gray.

The area A9 is displayed in gray. A character pattern is displayed on the area A9 by the above-mentioned character codes.

Figure 4A:
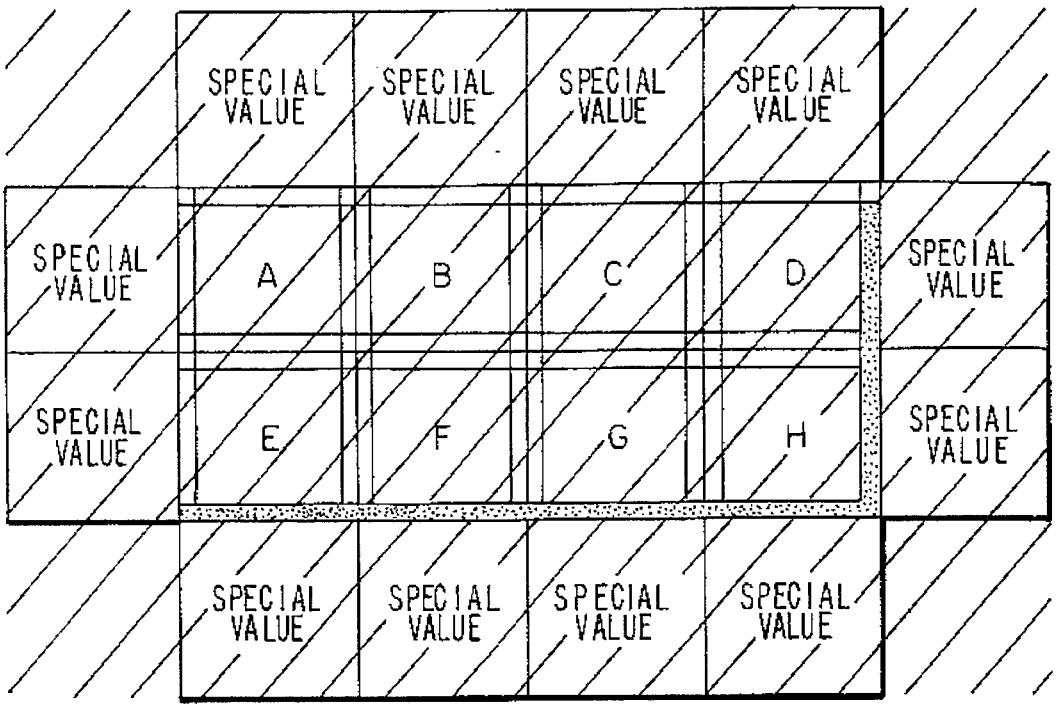
FIGS. 4A and 4B are schematic diagrams showing synthesized pattern signals according to the present invention, respectively.

Therefore, when character codes A through H are set on the displaying portion formed of two rows and the attribute codes of the special values are set on the peripheral displaying portions, a synthesized pattern signal is formed such that, as shown in FIG. 4A, a shade pattern is added to the peripheral portions of the display portion formed of two rows to thereby display the character displaying portion in the pop-up mode.

Figure 4B:
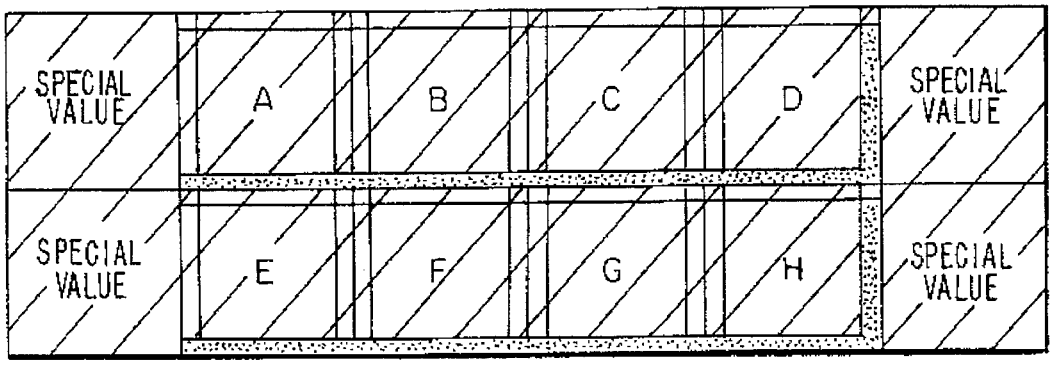

In the above-mentioned embodiment, if the attribute codes corresponding to the displaying portions B2, B5 are constantly regarded as being the attribute codes of the special value, then it is possible to form a synthesized pattern signal in which shade patterns are added to the two rows as shown in FIG. 4B.

As described above, according to the above-mentioned apparatus, since the displaying portion of one character is divided into divisional portions and characters are displayed on the divisional portions in response to identified results of information of peripheral characters, the shade pattern, for example, can be added to characters or character string by the simple circuit arrangement with ease without using special character patterns and display attribute codes formed of many bits.

As a second embodiment of the present invention, how to add shade patterns to a desired character string or the like so that a character displaying portion is displayed in the pop-up mode or pull-down mode will be described below.

In this embodiment, attribute codes are classified as a pop-up mode attribute code for displaying a character displaying portion in the pop-up mode, a pull-down mode attribute code for displaying a character displaying portion in the pull-down mode and an attribute code which is neither the pop-up mode attribute code nor the pull-down mode attribute code. Specifically, one portion of the attribute code that is used in usual display is employed as a pop-up mode attribute code and the other portion of this attribute code is employed as a pull-down mode attribute code. An attribute code of special value is employed as an attribute code which is neither the pop-up mode attribute code nor the pull-down mode attribute code. The pop-up mode attribute code will be referred hereinafter to as "attribute code U", the pull-down mode attribute code will be referred hereinafter to as "attribute code D", and the attribute code which is neither the attribute code U nor the attribute code D will be referred hereinafter to as "attribute code N" for simplicity. Displaying done by the attribute code of the special value is defined as a space, for example.

In this embodiment, attribute codes are identified by using attribute code signals displayed on slant direction displaying portions B6, B7, B8, B9 in addition to attribute code signals displayed on the above-mentioned displaying portions B1 through B5 which display one character.

The pattern generator 9 detects an attribute code corresponding to the displaying portion B1. If the attribute code thus detected is the attribute code N, the whole display area is made transparent. If on the other hand the attribute code corresponding to the displaying portion B1 is the attribute code U or D, the areas A1 through A9 are respectively displayed depending upon the attribute code U or D as follows.

Displaying using the attribute code U will be described initially.

Figure 5A:
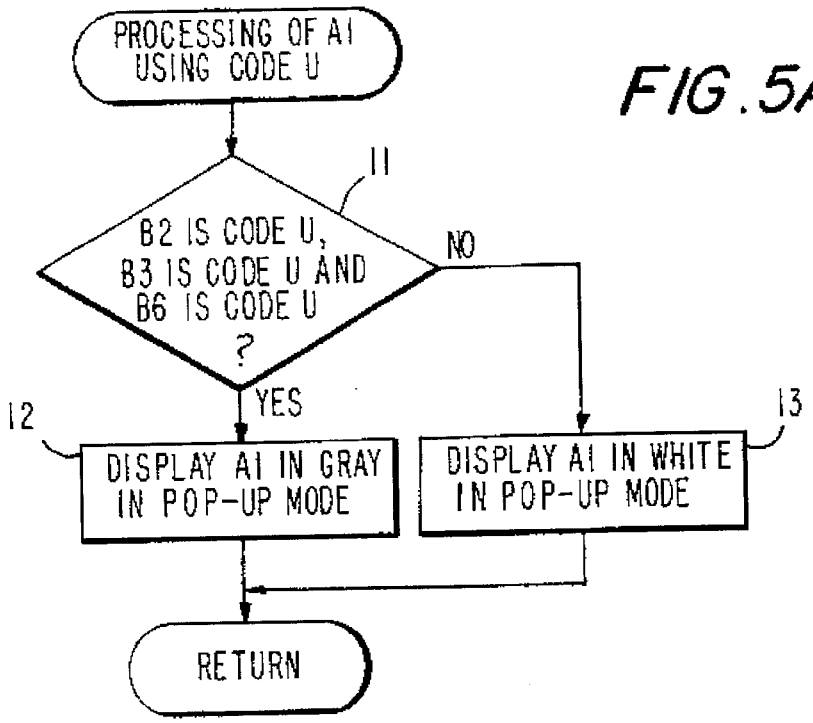
FIGS. 5A, 5B, FIGS. 6A, 6B, FIGS. 7A, 7B and FIGS. 8A, 8B are flow charts to which reference will be made in explaining operation of the second embodiment according to the present invention, respectively.

Referring to a flowchart of FIG. 5A, following the start of the processing in the area A1, attribute codes of the displaying portions B2, B3, B6 are identified at decision step 11. If all attribute codes of the displaying portion B2, B3, B6 are the attribute codes U as represented by a YES at decision step 11, then the processing proceeds to the next step 12, whereat the area A1 is displayed in gray in the pop-up mode. If any one of the above attribute codes corresponding to the displaying portions B2, B3, B6 is the attribute code (i.e., attribute code D or N) other than the attribute code U as represented by a NO at decision step 11, then the processing proceeds to step 13, whereat the area A1 is displayed in white in the pop-up mode.

Figure 5B:
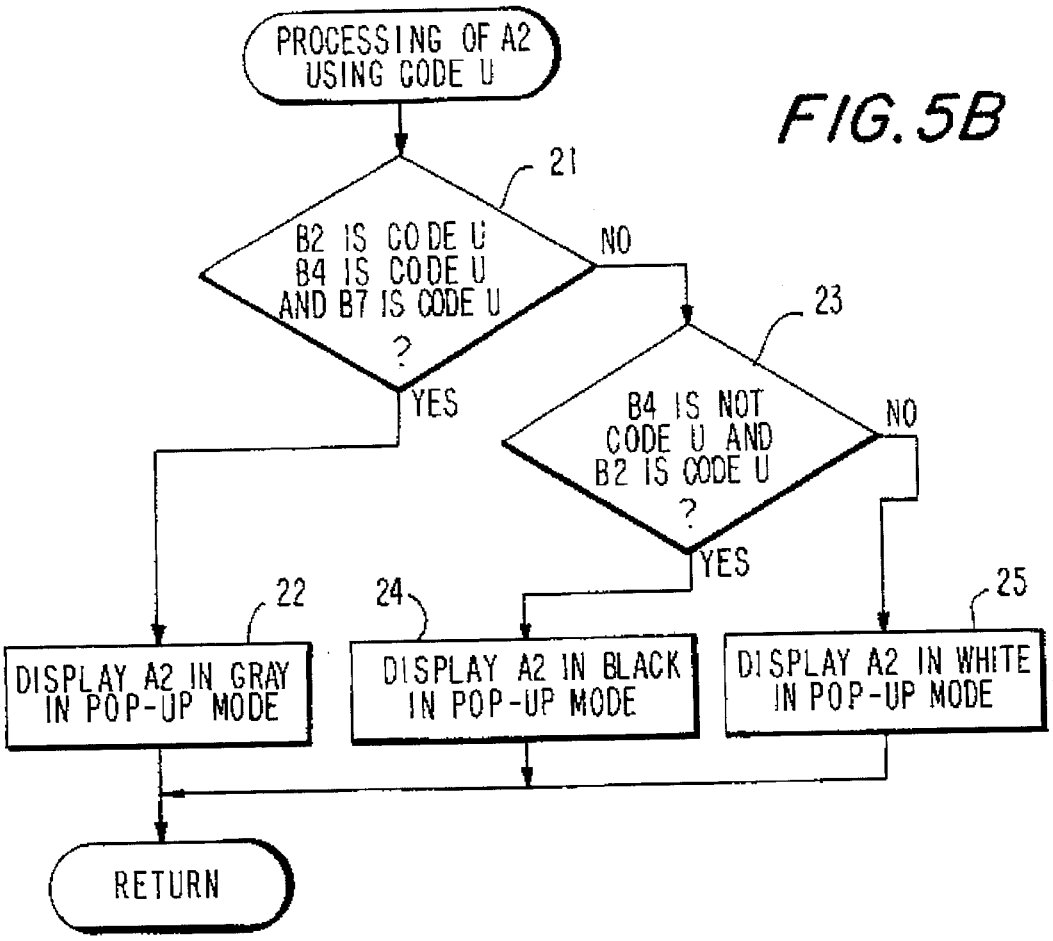

Referring to a flowchart of FIG. 5B, following the start of the processing in the area A2, the attribute codes corresponding to the displaying portions B2, B4, B7 are identified at decision step 21. If all attribute codes corresponding to the displaying portions B2, B4, B7 are the attribute codes U as represented by a YES at decision step 21, then the processing proceeds to step 22, whereat the area A2 is displayed in gray in the pop-up mode. If on the other hand any one of the attribute codes of the displaying portions B2, B4, B7 is the attribute code (i.e., attribute code D or N) other than the attribute code U as represented by a NO at decision step 21, then the processing proceeds to the next decision step 23. In decision step 23, the attribute codes corresponding to the displaying portions B2, B4 are identified. If the attribute code corresponding to the displaying portion B4 is not the attribute code U and the attribute code corresponding to the displaying portion B2 is the attribute code U as represented by a YES at decision step 23, then the processing proceeds to step 24, whereat the area A2 is displayed in black in the pop-up mode. If a NO is outputted at decision step 23, then the processing proceeds to step 25, whereat the area A2 is displayed in gray in the pop-up mode.

In the area A3, processing similar to that of the flowchart of FIG. 5B is executed. In this case, the displaying portions B2, B4, B7 are replaced with the displaying portions B3, B5, B8, respectively. In step 24, the area A3 is displayed in white in the pop-up mode and in step 25, the area A3 is displayed in black in the pop-up mode.

In the area A4, processing similar to that of the flowchart of FIG. 5A is executed. In this case, the displaying portions B2, B3, B6 are replaced with the displaying portions B4, B5, B9, respectively. In step 12, the area A4 is displayed in black in the pop-up mode.

Figure 6A:
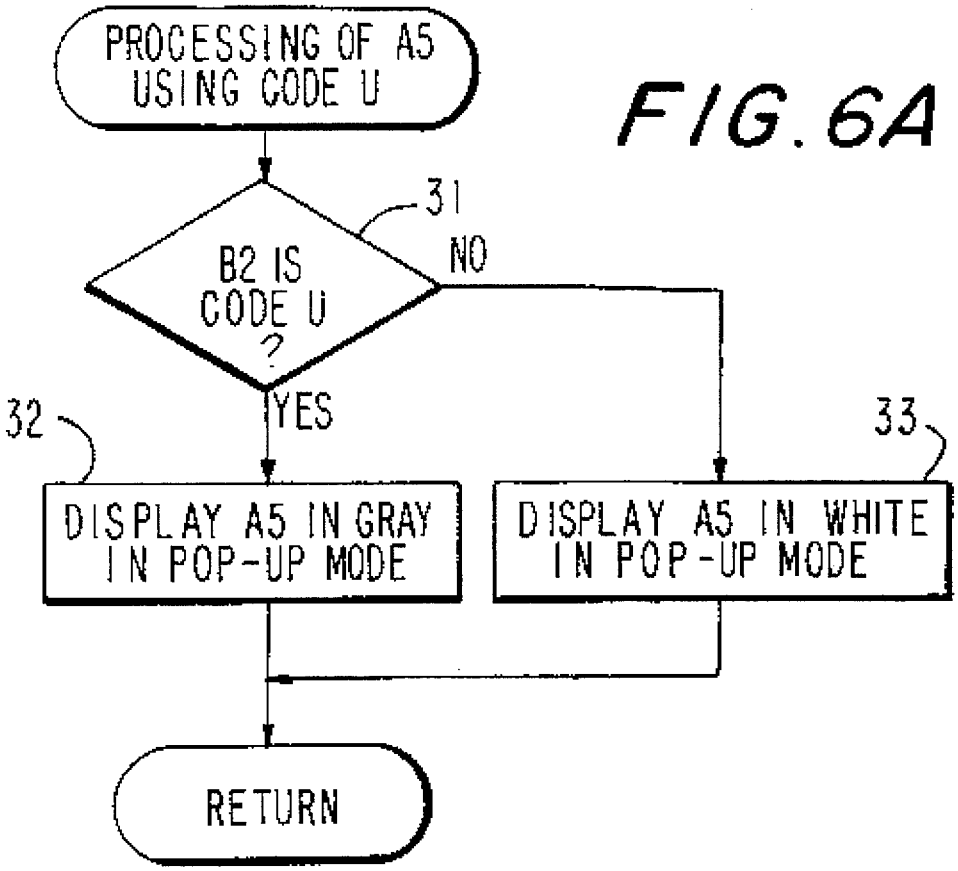

Referring to a flowchart of FIG. 6A, following the start of processing in the area A5, the attribute code corresponding to the displaying portion B2 is identified at decision step 31. If the attribute code corresponding to the displaying portion B2 is the attribute code U as represented by a YES at decision step 31, then the processing proceeds to step 32, whereat the area A5 is displayed in gray in the pop-up mode. If the attribute code corresponding to the displaying portion B2 is the attribute code (i.e., attribute code D or N) other than the attribute code U as represented by a NO at decision step 31, then the processing proceeds to step 33, whereat the area A5 is displayed in white in the pop-up mode.

In the area A6, processing similar to that of the flowchart of FIG. 6A is executed. In this case, the displaying portion B2 is replaced with the displaying portion B3.

In the area A7, processing similar to that of the flowchart of FIG. 6A is executed. In this case, the displaying portion B2 is replaced with the displaying portion B4 and in step 33, the area A7 is displayed in black in the pop-up mode.

In the area A8, processing similar to that of the flowchart of FIG. 6A is executed. In this case, the displaying portion B2 is replaced with the displaying portion B5, and in step 33, the area A8 is displayed in black in the pop-up mode.

Figure 6B:
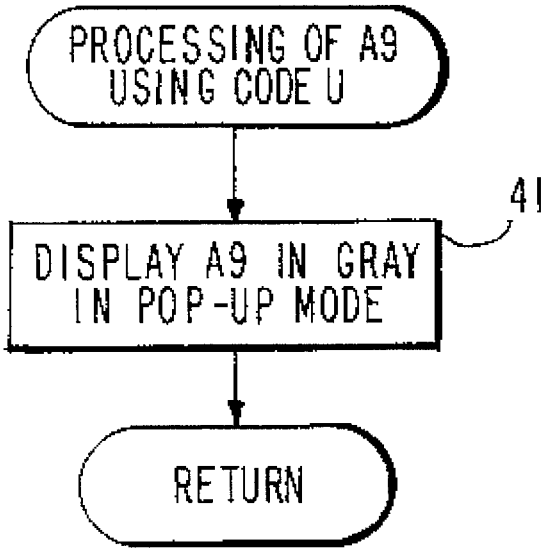

In the area A9, as shown in a flowchart of FIG. 6B, following the start of processing in the area A9, the area A9 is displayed in gray in the pop-up mode in step 41.

Then, displaying using the attribute code D will be described below.

Figure 7A:
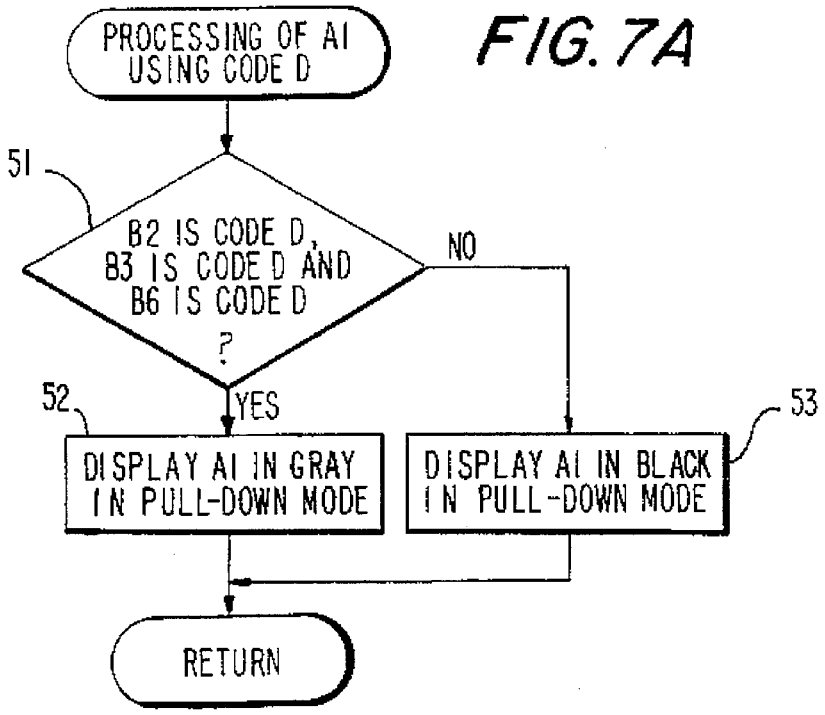

As shown in a flowchart of FIG. 7A, following the start of processing in the area A1, the attribute codes corresponding to the displaying portions B2, B3, B6 are identified at decision step 51. If all attribute codes corresponding to the displaying portions B2, B3, B6 are the attribute codes D as represented by a YES at decision step 51, then the processing proceeds to step 52, whereat the area A1 is displayed in gray in the pull-down mode. If on the other hand any one of the attribute codes corresponding to the displaying portions B2, B3, B6 is the attribute code (i.e., attribute code U or N) other than the attribute code D as represented by a NO at decision step 51, then the processing proceeds to step 53, whereat the area A1 is displayed in black in the pull-down mode.

Figure 7B:
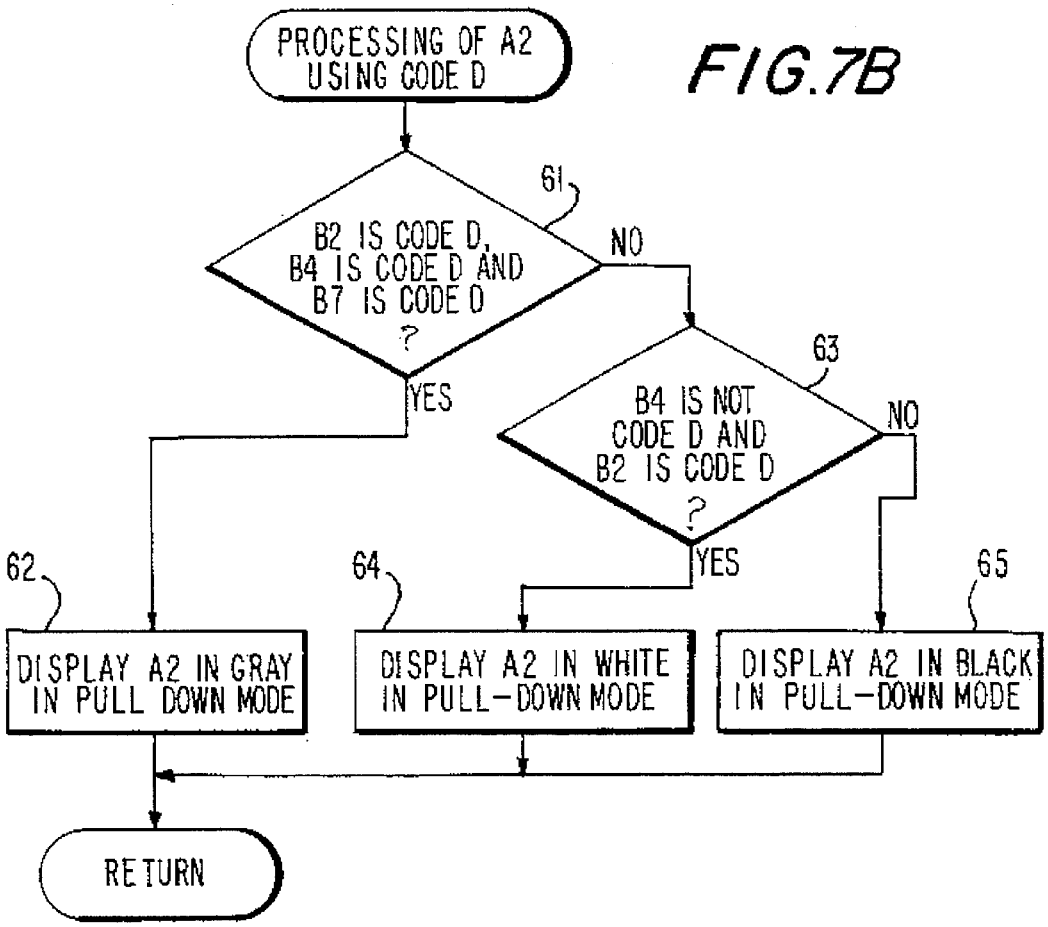

As shown in FIG. 7B, following the start of processing in the area A2, attribute codes corresponding to the displaying portions B2, B4, B7 are identified at decision step 61. If all attribute codes corresponding to the displaying portions B2, B4, B7 are the attribute codes D as represented by a YES at decision step 61, then the processing proceeds to step 62, whereat the area A2 is displayed in gray in the pull-down mode. If on the other hand any one of the attribute codes corresponding to the displaying portions B2, B4, B7 is the attribute code (i.e., attribute code U or N) other than the attribute code D as represented by a NO at decision step 61, then the processing proceeds to the next decision step 63. Attribute codes corresponding to the displaying portions B2, B4 are identified at decision step 63. If the attribute code corresponding to the displaying portion B4 is not the attribute code D and the attribute code corresponding to the displaying portion B2 is the attribute code D as represented by a YES at decision step 63, then the processing proceeds to step 64, whereat the area A2 is displayed in white in the pull-down mode. If a NO is outputted at decision step 63, then the processing proceeds to step 65, whereat the area A2 is displayed in black in the pull-down mode.

In the area A3, processing similar to that o the flowchart of FIG. 7B is executed. In this case, the displaying portions B2, B4, B7 are replaced with the displaying portions B3, B5, B8. In step 64, the area A3 is displayed in black in the pull-down mode, and in step 65, the area A3 is displayed in white in the pull-down mode.

In the area A4, processing similar to that of the flowchart of FIG. 7A is executed. In this case, the displaying portions B2, B3, B6 are replaced with the displaying portions B4, B5, B9. In step 52, the area A4 is displayed in white in the pull-down mode.

Figure 8A:
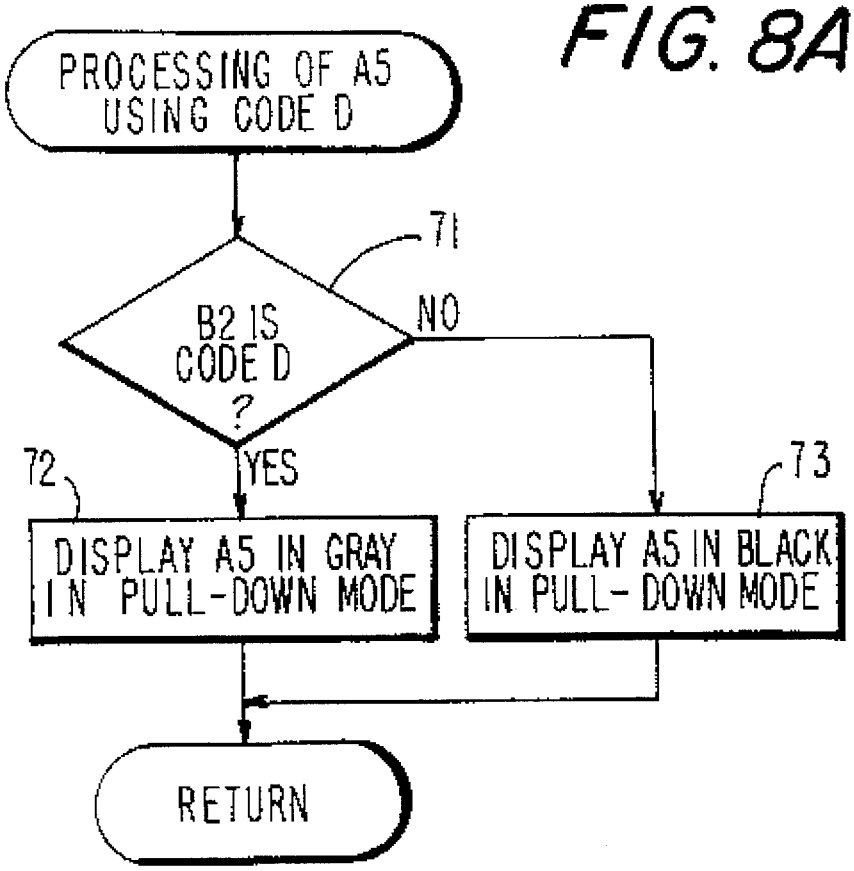

Referring to a flowchart of FIG. 8A, following the start of processing in the area A5, the attribute code corresponding to the displaying portion B2 is identified at decision step 71. If the attribute code corresponding to the displaying portion B2 is the attribute code D as represented by a YES a decision step 71, then the processing proceeds to step 72, whereat the area A5 is displayed in gray in the pull-down mode. If a NO is outputted at decision step 71, then the processing proceeds to step 73, whereat the area 73 is displayed in black in the pull-down mode.

In the area A6, processing similar to that of the flowchart of FIG. 8A is executed. In this case, the displaying portion B2 is replaced with the displaying portion B3.

In the area A7, processing similar to that of the flowchart of FIG. 8A is executed. In this case, the displaying portion B2 is replaced with the displaying portion B1, and in step 73, the area A7 is displayed in white in the pull-down mode.

In the area A8, processing similar to that of the flowchart of FIG. 8A is executed. In this case, the displaying portion B2 is replaced with the displaying portion B, and in step 73, the area A8 is displayed in white in the pull-down mode.

Figure 8B:
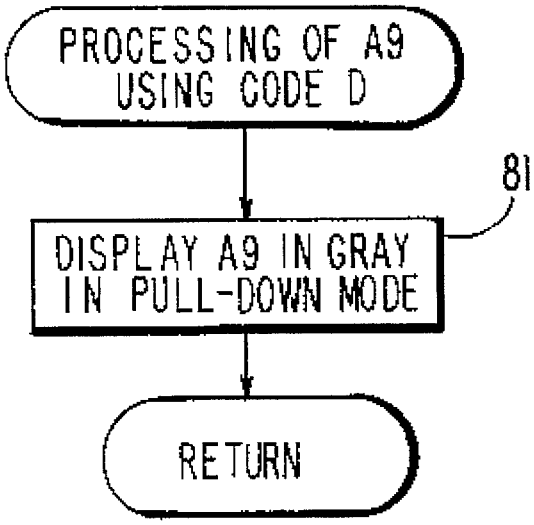

Referring to a flowchart of FIG. 8B, following the start of processing in the area A9, the area A9 is displayed in gray in the pull-down mode, and then the processing is returned.

Figures 9A, 9B:
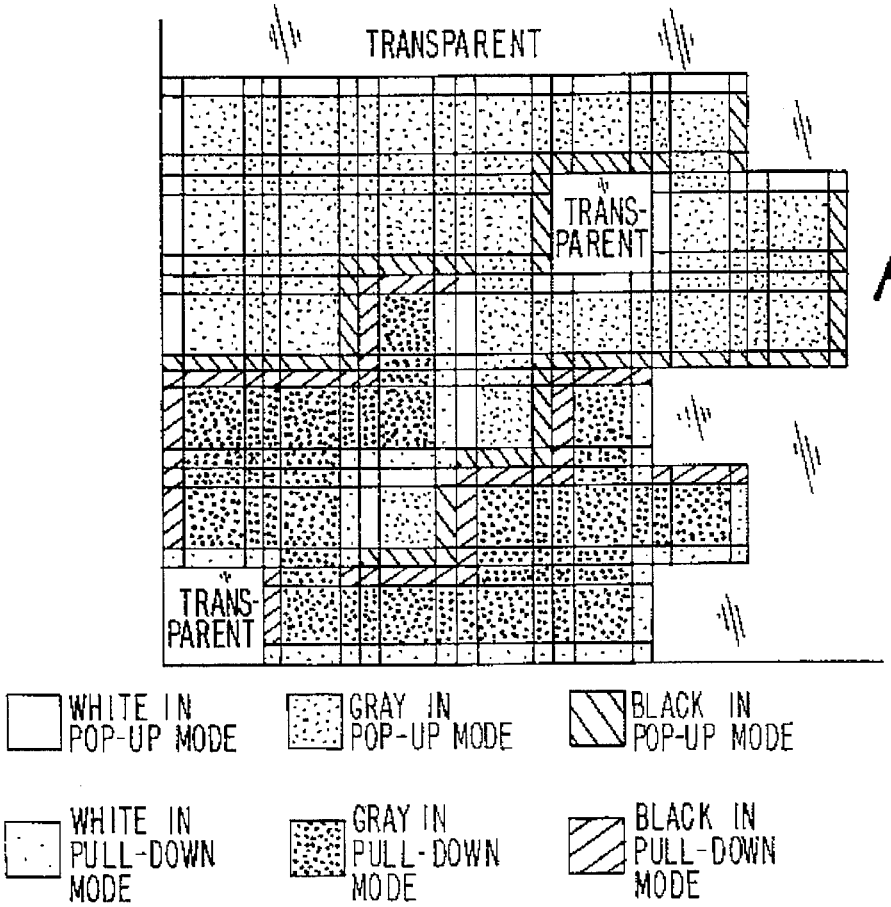
FIGS. 9A, 9B are diagrams used to explain in example of a synthesized pattern signal according to the present invention.

Therefore, when attribute codes corresponding to respective displaying portions are gassified as shown in FIG. 9A, there is formed a synthesized pattern signal in which shade patterns are added tot he respective peripheral displaying portions so that the character displaying portions of characters corresponding to the attribute codes U are displayed in the pop-up mode and that the character displaying portions of characters corresponding to the attribute codes D are displayed in the pull-down mode as shown in FIG. 9B.

While the white colors of t he attribute codes U and D, black colors of the attribute codes U and D and gray colors of the attribute codes U and D may be the same white color, the same black color and the same gray color as described above, the present invention is not limited thereto. If the colors of the attribute codes U are made brighter and the colors of the attribute codes D are made darker, then the pop-up mode displaying and the pull-down mode displaying of character displaying portions can be emphasized more effectively.

Figure 10A:
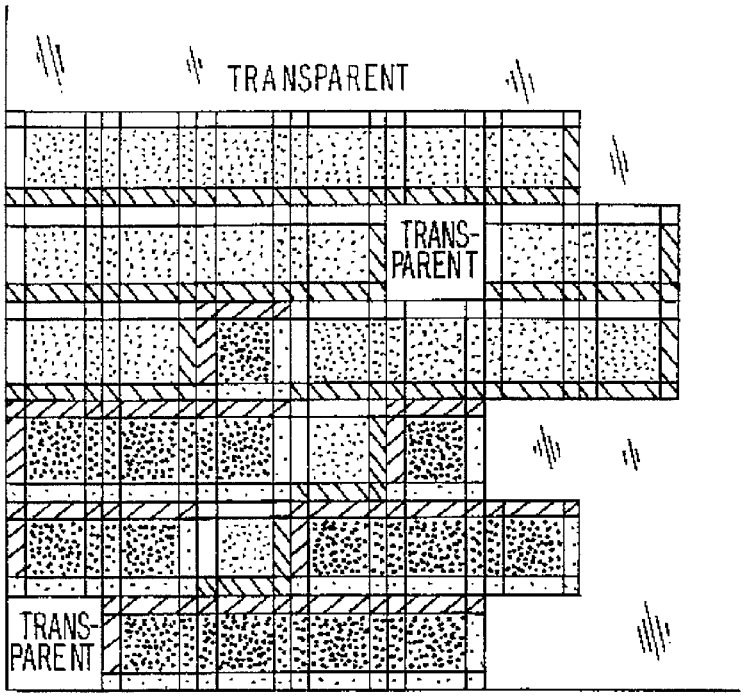
FIGS. 10A, 10B are diagrams used to explain another example of the synthesized pattern signal according to the present invention.

In the aforesaid embodiments, when the areas A1, A2 and A5 are constantly displayed by the attribute codes U in white in the pop-up mode, the areas A3, A4, A8 are constantly displayed by the attribute codes U in black in the pop-up mode, the areas A1, A2, A5 are constantly displayed by the attribute code D in black in the pull-down mode and the areas A3, A4, A8 are constantly displayed by the attribute codes D in white in the pull-down mode, it is possible to form a synthesized pattern signal in which shade patterns are added to respective peripheral displaying portions as shown in FIG. 10A.

Figure 10B:
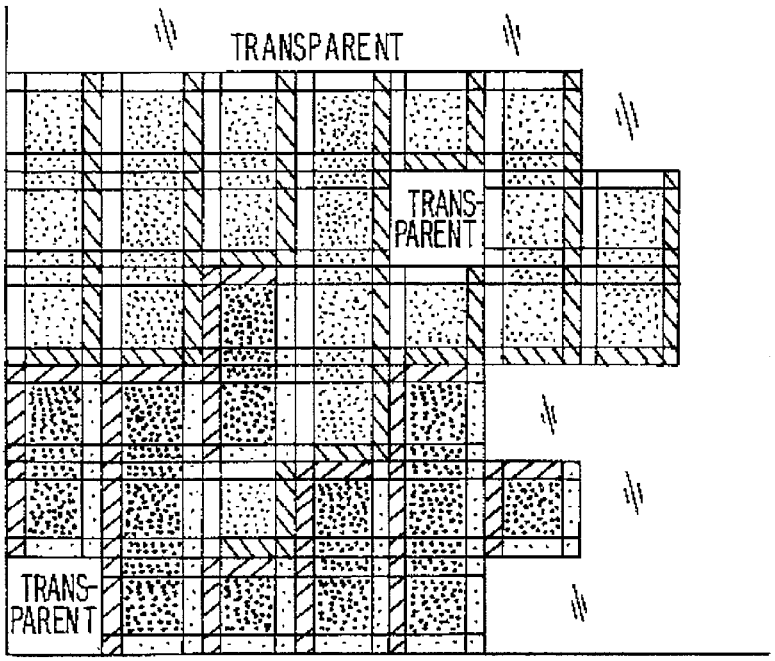

Further, in the above-mentioned embodiments, when the areas A1, A3, A6 are constantly displayed by the attribute codes U in white in the pop-up mode, the areas A2, A4, A7 are constantly displayed by the attribute codes U in black in the pop-up mode, the areas A1, A3, A6 are constantly displayed by the attribute codes D in black in the pull-down mode and the areas A2, A4, A7 are constantly displayed by the attribute codes D in white in the pull-down mode, it is possible to form a synthesized pattern signal in which shade patterns are added to respective peripheral displaying portions as shown in FIG. 10B.

In the aforesaid embodiments, when displaying portions are located at end portions in the vertical and horizontal directions on the picture screen, the end portions are identified by the pattern generator 9. Then, the processing may be executed on the assumption such that attribute codes of special values exist outside the above end portions. Alternatively, the processing may be executed on the assumption that attribute codes which are the same as those of the displaying portions exist outside the above end portions.

While the displaying attribute codes have been used so far, according to the first embodiment, the displaying attribute code may be formed of 1 bit. Also, the displaying attribute code may be formed of 2 bits according to the second embodiment. Therefore, the displaying attribute code need not be formed of many bits. Furthermore, a pseudo-attribute code may be generated on the basis of existence or absence of the character code.

While the displaying portion is rectangular in shape as described above, the present invention is not limited thereto and the displaying portion may be polygonal in shape.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. An apparatus for shading a character displaying area on a monitor, said character displaying area being divided into a center area and a peripheral area and a character being displayed in said center area of said character displaying area, comprising:

storage means for storing first display data to be displayed in said character displaying area and for storing second display data to be displayed in an adjacent character displaying area on said monitor;

comparator means for comparing said first display data with said second display data to produce a comparison result; and control means, responsive to said comparison result, for controlling a shade of said peripheral area.

2. The apparatus according to claim 1, wherein said peripheral area is divided into a plurality of divisional peripheral areas and said control means controls a shade of one of said divisional peripheral areas which is adjacent to said adjacent character displaying area.

3. The apparatus according to claim 2, wherein said control means further comprises means for identifying a pop-up or a pull-down mode of said character displaying area.

4. The apparatus according to claim 3, wherein said control means changes said shade of one of said divisional peripheral areas according to the mode of said character displaying area.

5. The apparatus according to claim 4, wherein said character displaying area comprises a rectangular form having at least four divisional peripheral areas, said four divisional peripheral areas comprising upper, lower, left and right areas of said rectangular form.

6. A method for shading a character displaying area which is displayed on a monitor, comprising the steps of:

generating display data to be displayed in a character displaying area on said monitor, said character displaying area being divided into a center area and a peripheral area;

comparing said display data with display data which are displayed in an adjacent character displaying area on said monitor to produce a comparison output signal; and controlling a shade of said peripheral area as a function of said comparison output signal.

7. An apparatus for coloring a character displaying area on a monitor, said character displaying area being divided into a center area and a peripheral area and a character being displayed in said center area of said character displaying area, comprising:

storage means for storing first display data to be displayed in said character displaying area and for storing second display data to be displayed in an adjacent character displaying area on said monitor;

comparator means for comparing said first display data with said second display data to produce a comparison result; and control means, responsive to said comparison result, for controlling a color of said peripheral area.

8. The apparatus according to claim 7, wherein said peripheral area is divided into a plurality of divisional peripheral areas and said control means controls a color of one of said divisional peripheral areas which is adjacent to said adjacent character displaying area.

9. The apparatus according to claim 8, wherein said control means further comprises means for identifying a pop-up or a pull-down mode of said character displaying area.

10. The apparatus according to claim 9, wherein said control means changes said color of one of said divisional peripheral areas according to the mode of said character displaying area.

11. The apparatus according to claim 10, wherein said character displaying area comprises a rectangular form having at least four divisional peripheral areas, said four divisional peripheral areas comprising upper, lower, left and right areas of said rectangular form.

12. A method for coloring a character displaying area which is displayed on a monitor, comprising the steps of:

generating display data to be displayed in a character displaying area on said monitor, said character displaying area being divided into a center area and a peripheral area;

comparing said display data with display data which are displayed in an adjacent character displaying area on said monitor to produce a comparison output signal; and controlling a color of said peripheral area as a function of said comparison output signal.

* * * * *